US005339972A

United States Patent [19]

Crosnier et al.

[11] Patent Number: 5,339,972

[45] Date of Patent: * Aug. 23, 1994

[54] DEVICE FOR TOTAL AND IMMEDIATE CLOSURE OF BOTTLE-LIKE CONTAINERS

[76] Inventors: Daniel Crosnier, 14 rue Jacques Lanty, 76550 Offranville, France; Jean-Marie Dulery, 53 avenue Pierre Semard, 94210 La Varenne, France

[ * ] Notice: The portion of the term of this patent subsequent to Dec. 21, 2010 has been disclaimed.

[21] Appl. No.: 65,803

[22] Filed: May 21, 1993

Related U.S. Application Data

[63] Continuation of Ser. No. 816,752, Jan. 2, 1992, Pat. No. 5,271,513.

[30] Foreign Application Priority Data

Oct. 17, 1991 [FR] France ..... 91 12998

[51] Int. Cl.[5] ..... B65D 41/58

[52] U.S. Cl. ..... 215/320; 215/223; 222/213; 401/186; 401/270; 401/271

[58] Field of Search ..... 215/320, 228; 222/213, 222/209, 212, 207, 96; 401/186, 270, 271

[56] References Cited

U.S. PATENT DOCUMENTS

| | | | |
|---|---|---|---|
| 2,185,608 | 1/1940 | Rose | 220/207 |
| 3,244,332 | 4/1966 | Rogers | 222/213 |
| 3,788,528 | 1/1974 | Ogie | 222/209 |
| 4,102,476 | 7/1978 | Loeffler | 222/209 |
| 4,559,052 | 12/1985 | Robin | 604/403 |
| 4,726,386 | 2/1988 | Schultz | 401/186 |
| 4,748,990 | 6/1988 | Brown et al. | 401/186 |
| 4,785,978 | 11/1988 | Kano et al. | 222/213 |

FOREIGN PATENT DOCUMENTS

| | | |
|---|---|---|
| 0247885 | 12/1987 | European Pat. Off. . |
| 2395682 | 1/1979 | France . |
| 0620603 | 12/1980 | Switzerland . |

*Primary Examiner*—Joseph Man-Fu Moy

*Attorney, Agent, or Firm*—Ostrolenk, Faber, Gerb & Soffen

[57] ABSTRACT

Total and immediate closure device which can be fitted on various containers, in particular bottles, tubes and jars, whether rigid or flexible, includes a hood (10) made of an elastic deformable material which can be fitted on the mouth (21) of a container (2). Hood (10) is pierced axially with an opening (11) into which there is tightly inserted a cylindrical body (22) an end of which is located inside of the container (2) penetrating into the opening (21) thereof and is rigidly fastened to the inner part (24) of said container (2) so as to provide a space along the outside of body (22) for the passage of the contents (23) from the said container (2).

12 Claims, 6 Drawing Sheets

DEVICE FOR TOTAL AND IMMEDIATE CLOSURE OF BOTTLE-LIKE CONTAINERS

This is a continuation of application Ser. No. 07/816,753, filed Jan. 2, 1992, now U.S. Pat. No. 5,271,513.

BACKGROUND OF THE INVENTION

The present invention relates to a device for total and immediate closure which can be placed on various containers, bottles, tubes, jars, whether rigid or flexible, which are used in the fields of pharmacy and cosmetics for liquid or paste products.

In these fields, the use of the products, whether in liquid or paste form and whatever the content, requires an effective closure device in order to avoid the partial drying out of said products.

The existing closure devices are in most cases formed of a simple cap which is fitted after use on the mouth of the container by thread or other fastening means.

In all cases, closing is effected by placing a cap of hard material on a container of hard material, which does not make it possible to obtain a perfect seal and entails the risk of the partial drying out of the product.

SUMMARY OF THE INVENTION

It is an object of the present invention to overcome this drawback, it proposing a device of simple design and reduced cost of manufacture which permits the immediate and complete closing of a container after use.

The closure device forming the object of the present invention comprises a hood made of an elastic deformable material which can be fitted on the mouth of the container, said hood having an axial hole into which there is closely inserted a cylindrical body of a diameter less than that of the mouth of the container, and the end of which located on the container side penetrates concentrically into said mouth, to the inner wall of which it is firmly attached at several points.

When the contents are placed under pressure, the contents exert pressure on the wall of the mouth of the said hood of deformable material, which moves away from the central cylindrical body permitting the contents to emerge. When the pressure on the content is released, the wall of the opening of the hood, due to its elasticity, resumes its initial position around the body, closing the container.

The elastic deformable material used to produce the hood of the device of the invention can be a natural rubber, an elastomer, a silicone, or an elastic thermoplastic material.

As examples of materials which can be employed mention is made of butadiene-styrene or butadieneacrylonitrile copolymers, polymers of chloroprene, butyl rubbers, thioplasts, ethylene/ethyl-acrylate or ethylene/vinyl-acetate copolymers, and amide block polyethers, this enumeration not being all inclusive.

It is to be noted that the present invention, associated with that described in patent application No. 91/03079 in the name of the present applicants and covering a dosaging device, makes it possible to obtain a dosaging device with total and immediate closure which is capable of multiple uses, by utilization of the properties of elasticity and tightness of a part made of elastomer, in order to aspirate the contents of the receptacle on which it is fitted.

By imparting said part of the somewhat modified shape of the hood of the closing device forming the object of the present invention and by placing it upstream of said hood, one obtains a dosaging distributor which is completely and immediately closable, and of simple design, requiring only a few parts as compared with the equivalent devices at present on the market. One can thus produce distributors for very small doses, in particular of the dropper type.

The closure device of the invention can advantageously be used for products containing volatile components such as nail lacquers, in which case its central cylindrical body can be extended by a brush permitting the application thereof.

Other features and advantages of the present invention will become apparent from the following description of the invention which refers to the accompanying drawings.

DETAILED DESCRIPTION OF THE INVENTION

Figure 1:
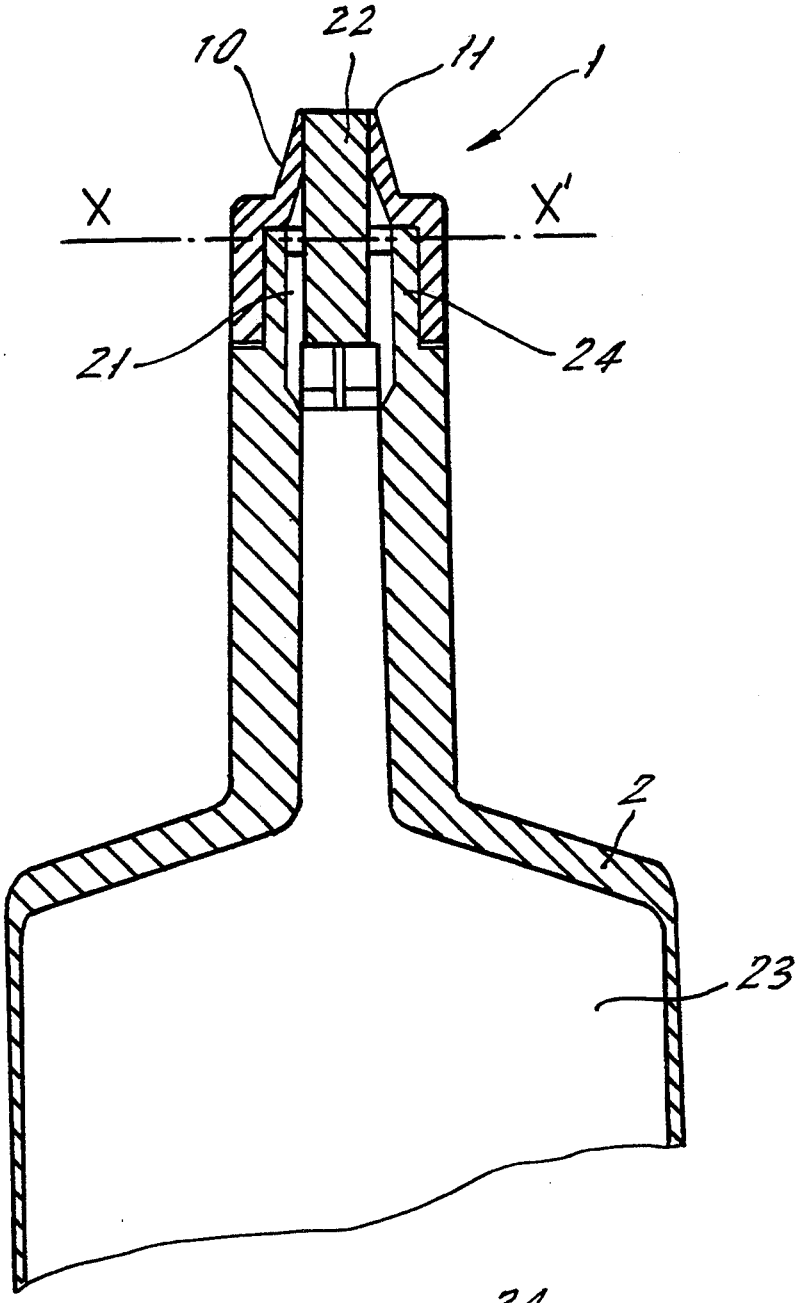
FIG. 1 is a vertical section through a first embodiment of the closure device according to the present invention.

If one refers to FIG. 1, it can be seen that the closure device 1 of the present invention is assembled at the end of a container 2 on the mouth 21 of the container 2. This closure device comprises, on the one hand, a hood 10 of elastic, deformable material surrounding the mouth of the container and pierced axially by an opening 11 and, on the other hand, a cylindrical body 22 firmly attached to the container 2 concentric to the opening or mouth 21, said cylindrical body 22 being tightly inserted in the opening 11 of the hood 10.

Figure 1A:
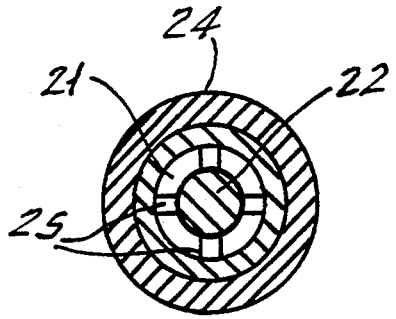
FIG. 1*a* is a sectional view along the line XX' of FIG. 1.

Referring to FIG. 1*a* it can be seen that the cylindrical body 22 is firmly attached to the wall 24 of the mouth 21 via uniformly spaced bridges 25 which maintain said cylindrical body 22 at a given distance from said wall 24.

Figure 2:
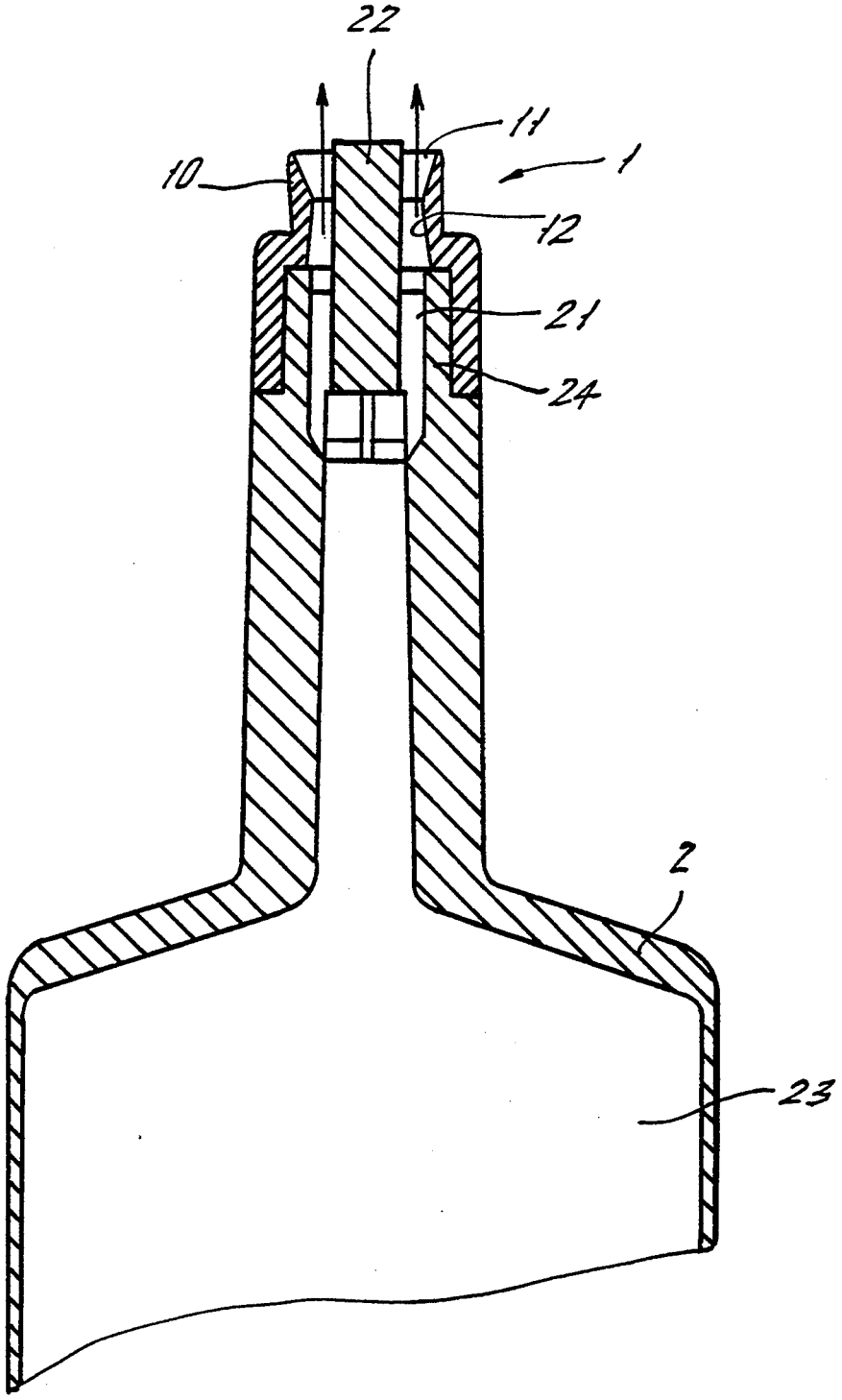
FIG. 2 is a vertical section through the same device upon the expulsion of the content.

Referring now to FIG. 2, it can be seen that when pressure is applied on the contents 23 the contents are compressed, at the level of the opening 21, on the zone of contact between the cylindrical body 22 and the internal wall 12 of the opening 11 of the hood 10. Due to the deformability of the hood 10, this inner wall 12 moves away from the surface of the cylindrical body 22, allowing the contents 23 to escape.

When the pressure is released, the hood 10 resumes its initial shape and closes the container 2, the contents 23 remaining sheltered from air.

Figure 3:
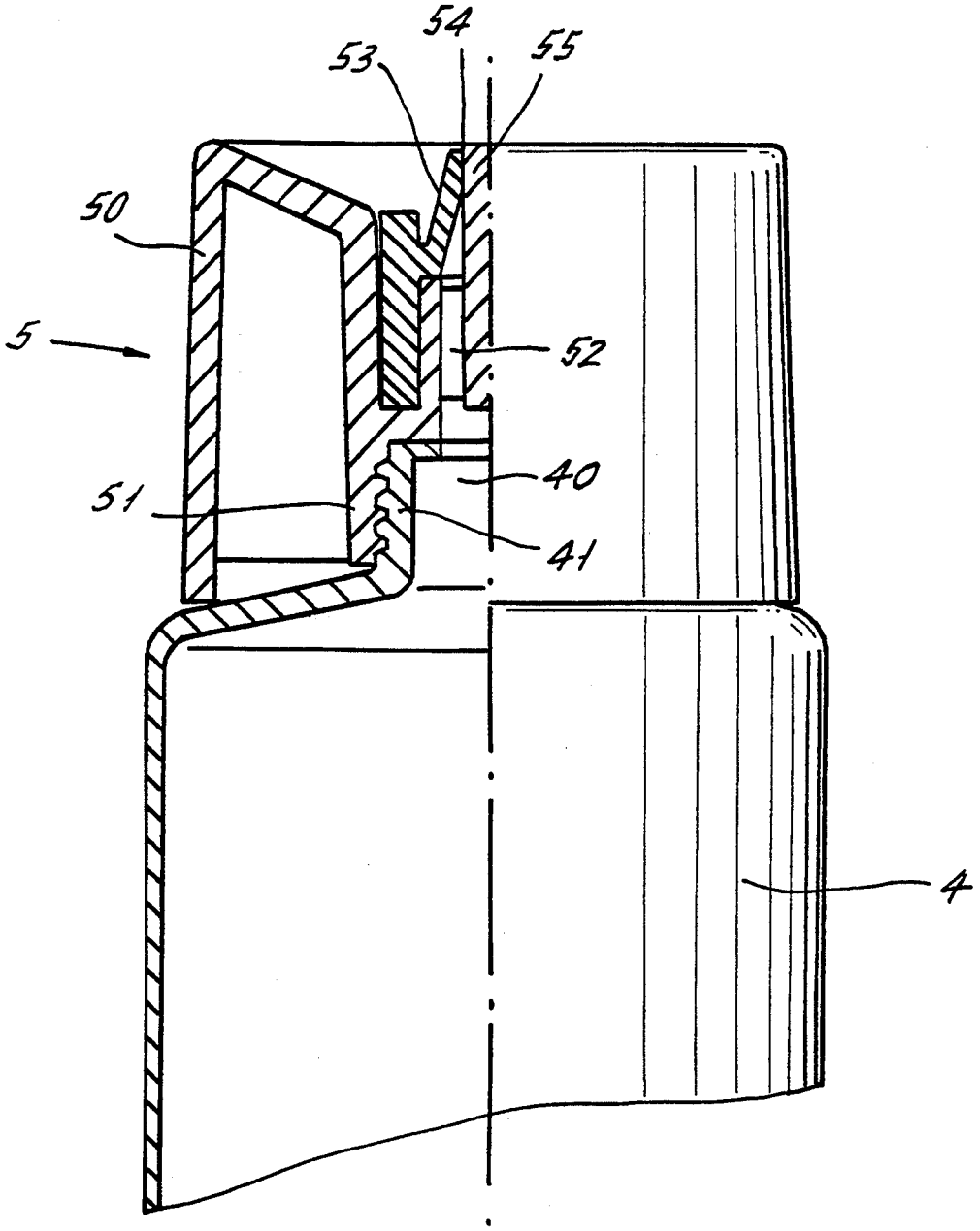
FIG. 3 is a partial section through a second embodiment of the device according to the invention.

Referring now to FIG. 3, it can be seen that the closure device of the invention can be fitted to any existing container, provided that the latter has a fastening means such as a screw thread.

In this FIG. 3 one can note a container 4 having an opening 40 provided on the outside with a screw thread 41 serving initially for the closing by means of a conventional cap, on which there is fitted a closure device 5 having an outer body 50, provided with a screw thread 51 which permits its attachment to the container 4, which is provided axially with an opening 52 which extends the opening 40, and having a hood 53 of elastic deformable material itself provided with an opening 54 in which there is tightly inserted a cylindrical body 55 which is firmly attached to the outer body 50 and is concentric to the opening 54.

Figure 4:
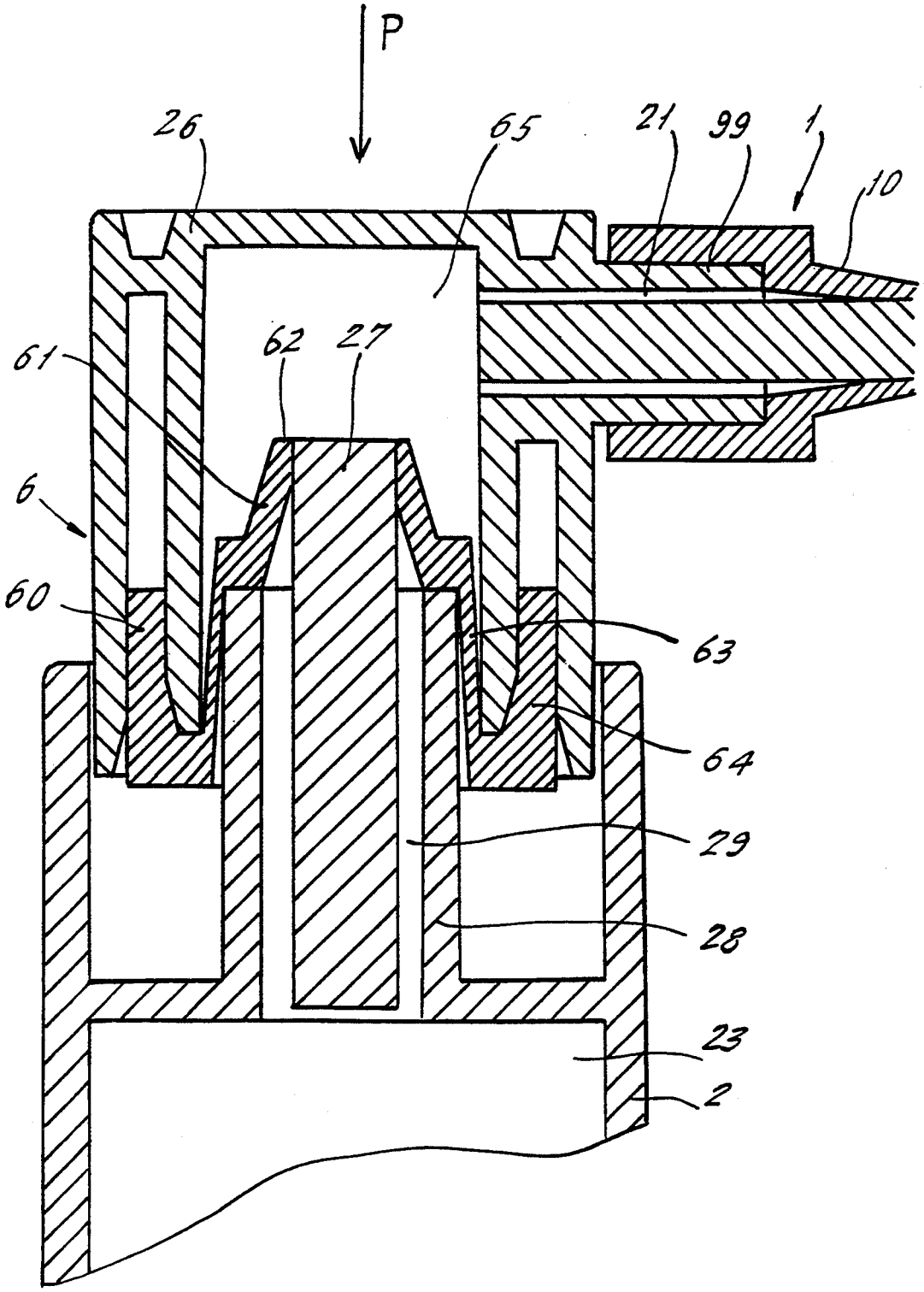
FIG. 4 is a partial section through the closure device associated with a dosaging device.

Referring now to FIG. 4, it can be seen that the closure device 1 can be associated with a dosaging device 6 such as described in Patent Application 91/03079.

This dosaging device 6 is formed of a part 60 of deformable material, comprising a part 61 similar to the hood 10, having an opening 62 in which there is tightly inserted a cylinder 27 firmly connected to the container 2 and placed concentrically in a tube 28, creating an annular space 29 communicating with the inside of the container 2 which contains the contents 23. This wall 61 is extended peripherally by a tubular body 63, the upstream or lower end of which has a rim 64 which permits its attachment to the cap 26 of the container. Exit neck or extension 99 projects sideways from cap 26. Mouth or exit passage 21 extends axially through exit neck 99.

As a result, under the action of a pressure P on the cap 26, the tubular body 63 of the part 60 is stretched and the product contained in a dosaging chamber 65 is expelled towards the mouth 21 of the chamber 65. Upon release of the cap 26, the tubular part 63 resumes its initial shape, causing the aspirating of the contents 23 into the chamber 65 through the annular space 29.

A closure device 1 located downstream of the dosaging chamber 65 permits the contents 23 of this dosaging chamber 65 not to be in contact with the outer air.

Figure 5:
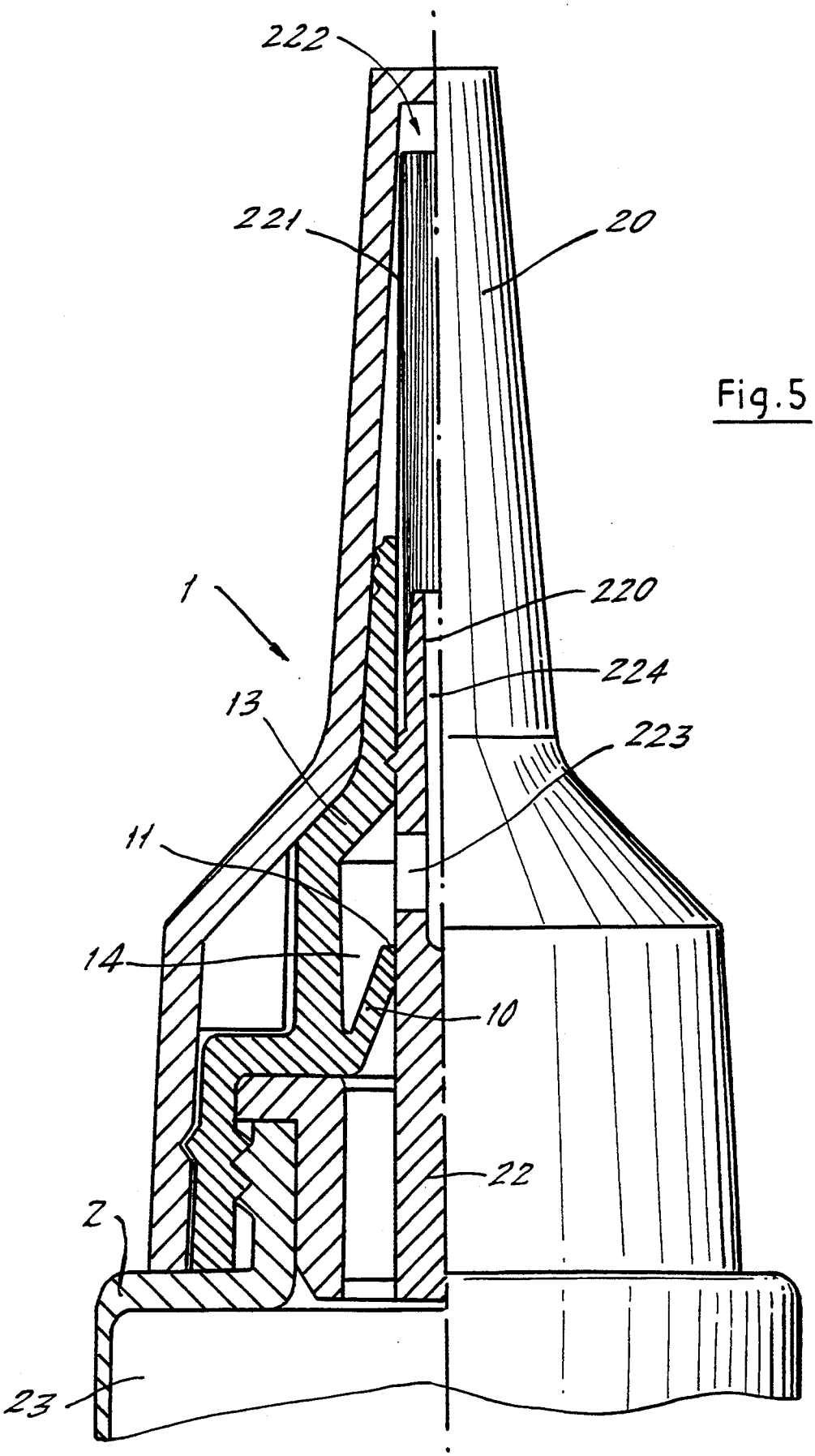
FIG. 5 is a partial section through a closure device used with a brush.

If one refers now to FIG. 5, it can be seen that the closure device of the invention can advantageously be applied to a bottle of nail polish.

In this embodiment, the cylindrical body 22 of the closure device has an extension 220 emerging from the hood 10 and at the end of which there are peripherally attached the bristles 221 of a brush 222.

The hood 10 is folded towards the outside at its base, forming an extension 13 the end of which covers the base of the bristles 221 and provides an annular space 14 above the opening 11 of the hood 10.

At the level of this annular space 14, the extension 220 of the cylindrical body 22 has radial openings 223 communicating with an axial channel 224 debouching between the bristles 221.

A pressure on the container 2 has the effect of expelling the contents 23 through the opening 11 of the cap 10, said contents 23 spreading out in the annular space 14 and then flowing through the openings 223 into the axial channel 224 up to the bristles 221 of the brush 222.

The unit comprising the brush and the closure device is covered by a hood 20 of hard material, the tightness between these two parts being assured by the contact between the inner wall of said hood 20 of hard material and the outer wall both of the hood 10 and of its extension 13, both made of a single block of elastic material.

Figure 6:
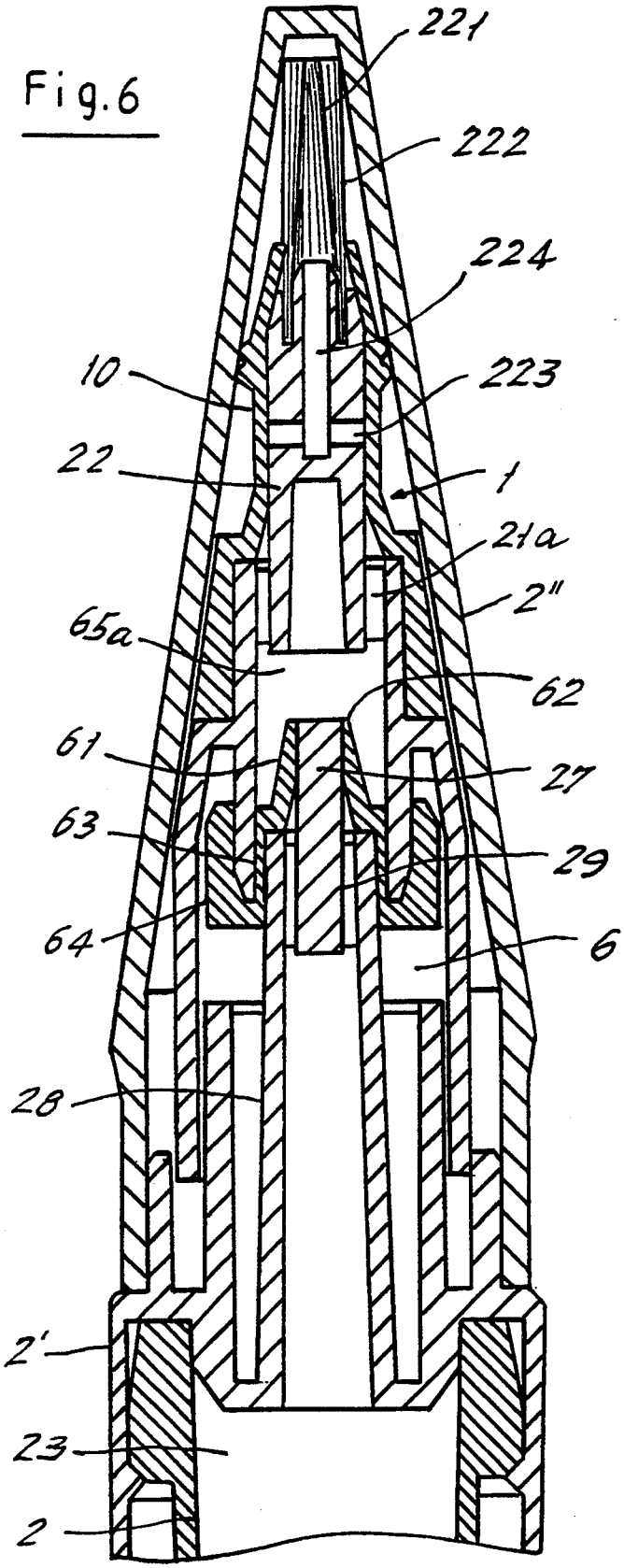
FIG. 6 is a partial section through another closure device used with a brush, associated with a dosaging device.
Figure 6A:
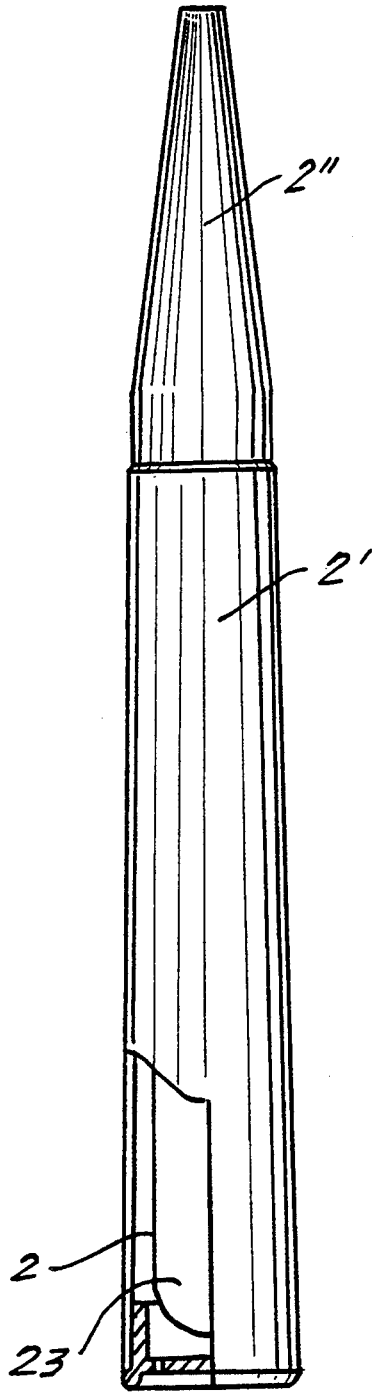
FIG. 6*a* is an overall view, in elevation, of another closure device used with a brush, associated with a dosaging device.

If one now refers to FIGS. 6 and 6*a*, there can be noted in these figures another device for the distributing of nail polish or other products of the same type, in which the closure device 1 is associated with the dosaging device 6 described above, so that the distribution of the polish is effected by pressure on the head of the distributor, in which case the container 2 is of flexible material and placed in a rigid envelope 2′ covered on top by a hood 2″ of hard material, which assembly may have the shape and the size of a fountain pen.

In this case it is not necessary to distribute a complete dose upon each pressing, the dosaging device being used, in particular, to pump the contents and force the contents from dosaging chamber 65*a* through exit passage 21*a*, and downstream through radial opening 223 and axial channel 224 up to the brush 222.

It goes without saying that the present invention is not limited to the above description of certain of its embodiments and may be subjected to a number of modifications without thereby going beyond the scope of the invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Closure means for an outlet passage that extends axially through an elongated tubular neck for a container, said closure means comprising:

first, second and third sections;

said first section including an elastically deformable rim unit operatively constructed to be fitted around said neck at its free downstream end through which flowable contents exit from said container, said rim unit including portions that define an opening aligned with said passage, and a cylindrical body having a diameter smaller than that of said outlet passage, said body being tightly fitted in said outlet passage in axial alignment therewith and with said portions of said rim unit normally being sealed against said body and closing said outlet passage;

said second section being depressible and including an annular portion of substantial depth having an open upstream end entered into an annular groove defined by said rim unit and surrounding said neck, said annular portion defining a dosaging chamber downstream of said neck for receiving said flowable contents as it exits through said outlet passage, an exit extension remote from said open upstream end, and an exit passage extending downstream from said chamber and axially through said exit extension;

said third section including a hood of elastically deformable material fitted on said exit extension at its downstream end on the outside thereof, said hood having an opening of substantial axial depth, another cylindrical body normally tightly fitted in said opening of said hood in axial alignment therewith and with portions of said hood which define said opening in said hood normally being sealed against said another cylindrical body and closing said exit passage, said another cylindrical body having an end that extends upstream of said opening of said hood and penetrates into said exit passage and is firmly attached to said second section;

said second section when depressed moving upstream along said neck and urging said rim unit to seal against said body to close said passage, while at this time said rim unit is caused to stretch, volume of said chamber decreases and flowable contents of said chamber are forced therefrom through said exit passage; and upon release of said second section after depressing same, said rim unit contracting from its stretched condition to expand said chamber, cause said hood to seal against said another body and cause flowable contents of said container to aspirate through said passage into said chamber.

2. Closure means as defined by claim 1 in which said annular groove is formed between inner and outer annular walls of said rim unit, said second section including an outer annular portion surrounding said annular portion to form a space therebetween into which said outer annular wall extends.

3. Closure means as defined by claim 1 in which with said second section in its normal non-depressed condition there exists a slim tapered relatively inner annular space between said inner annular wall and said neck, and a slim tapered relatively outer annular space between said inner annular wall and said annular portion of said second section.

4. Closure means as defined by claim 3 in which said annular spaces are reversely tapered.

5. Closure means as defined by claim 4 in which said annular groove is formed between inner and outer annular walls of said rim unit, said second section including an outer annular portion surrounding said annular portion to form a space therebetween into which said outer annular wall extends.

6. Closure means as defined by claim 1 in which the exit extension projects sideways of said dosaging chamber and said annular portion is closed opposite its said open upstream end.

7. Closure means as defined by claim 5 in which the exit extension is axially aligned with said tubular neck.

8. Closure means as defined by claim 7 in which the third section also includes brush means having bristles that extend downstream of said exit passage to receive flowable contents that are forced from said chamber by depressing said second section.

9. Closure means as defined by claim 8 in which said brush means is secured in its operative position by portions of said hood.

10. Closure means as defined by claim 1 in which the third section is mounted on second section and moves therewith as the latter is depressed in a forward stroke and is released to move rearward.

11. A total and immediate closure device which can be fitted on various containers, in particular bottles, tubes, jars, whether rigid or flexible, said device being characterized by the fact that it comprises a hood (10) made of an elastic deformable material and is adapted to be fitted on the mouth (21) of a container (2) on the outside thereof; said hood (10) including portions that define an opening (11) of substantial axial depth; a cylindrical body (22) normally tightly fitted in said opening (11) in axial alignment therewith and with said portions of said hood (10) defining said opening (11) normally being sealed against said body (22); said body (22) having an end upstream of said opening (11) adapted to penetrate into the mouth (21) of the container and be firmly attached to the inner wall (24) of said container (2) so as to provide an annular space between said body (22) and the inner wall for the passage in a downstream direction of the flowable contents (23) of said container (2) axially along the outside of said body and through said axial opening (11) as said portions of said hood which define said axial opening (11) are driven radially outward to separate from said member by forces that result from downstream movement of the flowable contents of said container, (2), said cylindrical body (22) having an extension (22) which projects downstream of the opening (11) of the hood (10); a brush (222) comprising bristles (221) mounted to said extension (220) along its periphery and projecting downstream of said extension (220); said hood (10) including a downstream extension (13) having its downstream end covering said bristles (221) at their upstream ends; upstream of said bristles (221) said downstream extension (13) of said hood (20) projecting radially outward to form another annular space (14) that extends upstream from the vicinity of the upstream end of said bristles (221), said body (22) having an axial passage (224) that is open at its downstream end and extends upstream therefrom to the vicinity of said axial opening (11), said body (22) also having radial opening means (223) disposed downstream of said axial opening (11), and connecting said axial passage (224) with said another annular space (14) whereby flowable material ejected through said axial opening (11) enters said another annular space (14) and then flows through said radial opening means (23) and said axial passage (224) to said bristles (221).

12. A device according to claim 11, also comprising a body (50) to which the hood (10) is secured; said body being provided with a means of attachment (51) which is adapted for mounting said device on a container (4) that is provided with a suitable fastening means.

* * * * *